US010457300B2

(12) United States Patent
Rahn

(10) Patent No.: US 10,457,300 B2
(45) Date of Patent: Oct. 29, 2019

(54) METHOD AND DEVICE FOR AUTOMATICALLY INFLUENCING TRACK-BOUND VEHICLES

(71) Applicant: SIEMENS AKTIENGESELLSCHAFT, Munich (DE)

(72) Inventor: Karsten Rahn, Cremlingen (DE)

(73) Assignee: Siemens Mobility GmbH, Munich (DE)

( * ) Notice: Subject to any disclaimer, the term of this patent is extended or adjusted under 35 U.S.C. 154(b) by 169 days.

(21) Appl. No.: 15/556,431

(22) PCT Filed: Feb. 26, 2016

(86) PCT No.: PCT/EP2016/054099
§ 371 (c)(1),
(2) Date: Sep. 7, 2017

(87) PCT Pub. No.: WO2016/146365
PCT Pub. Date: Sep. 22, 2016

(65) Prior Publication Data

US 2018/0105192 A1 Apr. 19, 2018

(30) Foreign Application Priority Data

Mar. 17, 2015 (DE) ..... 10 2015 204 769

(51) Int. Cl.
*B61L 3/16* (2006.01)
*B61L 1/14* (2006.01)
(Continued)

(52) U.S. Cl.
CPC ..... *B61L 3/16* (2013.01); *B61L 1/14* (2013.01); *B61L 15/0054* (2013.01);
(Continued)

(58) Field of Classification Search
None
See application file for complete search history.

(56) References Cited

U.S. PATENT DOCUMENTS

2005/0065726 A1* 3/2005 Meyer ..... B61L 25/021 701/470
2014/0229096 A1* 8/2014 Carlson ..... B61L 15/0027 701/301
(Continued)

FOREIGN PATENT DOCUMENTS

DE 10214224 A1 10/2003
DE 102007026407 A1 12/2008
(Continued)

OTHER PUBLICATIONS

Siemens, "Trainguard MT—Optimal performance with the world's leading automatic train control system for mass transit", A19100-V-100-B976 Siemens AG 2014, www.siemens.com/mobility/mobility—English version.
(Continued)

*Primary Examiner* — Jonathan M Dager
*Assistant Examiner* — Garrett F Evans
(74) *Attorney, Agent, or Firm* — Laurence Greenberg; Werner Stemer; Ralph Locher

(57) ABSTRACT

In a normal operating mode, track-bound vehicles report their respective position to a track-side device and the track-side device determines a respective movement authority taking into account the reported positions for the track-bound vehicles and transmits the movement authorities to the respective track-bound vehicle. If a track-bound vehicles is faulty and cannot ensure its integrity, and it is consequently not able to report a valid or reliable position, a switch-over into a fault mode takes place without interrupting the travel operation of the track-bound vehicles. In the fault mode the faulty track-bound vehicle determines a
(Continued)

position of one of its vehicle ends and reports the position together with information that it cannot ensure its integrity, to the track-side device. Movement authorities are then determined by the track-side device, taking into account the reported position of the one vehicle end and track vacancy information of a track-side track vacancy system.

12 Claims, 1 Drawing Sheet

(51) Int. Cl.
*B61L 15/00* (2006.01)
*B61L 27/00* (2006.01)
*B61L 25/02* (2006.01)

(52) U.S. Cl.
CPC ..... *B61L 15/0081* (2013.01); *B61L 25/02* (2013.01); *B61L 27/0066* (2013.01)

(56) References Cited

U.S. PATENT DOCUMENTS

2014/0350767 A1* 11/2014 Fries ..... B61L 27/0077 701/23
2015/0307119 A1* 10/2015 Ghaly ..... B61L 27/0038 246/122 R

FOREIGN PATENT DOCUMENTS

DE 102008023347 A1 11/2009
DE 102013101927 A1 8/2014
DE 102014210190 A1 12/2015
WO 2009139927 A2 11/2009

OTHER PUBLICATIONS

Heitmann R. et al., "Systeme zur Zugvollstaendigkeitsueberwachung", [Systems for Monitoring Train Completeness], Signal & Draht [89] Nov. 1997, pp. 22-25—English abstract.

* cited by examiner

METHOD AND DEVICE FOR AUTOMATICALLY INFLUENCING TRACK-BOUND VEHICLES

BACKGROUND OF THE INVENTION

Field of the Invention

The present invention relates to a method for automatically controlling tack-bound vehicles wherein, in a normal operating mode, the respective position of the track-bound vehicles is reported by them to a track-side device, a respective movement authority is determined for the track-bound vehicles by the track-side device, taking account of the reported positions, and said movement authority is transmitted to the respective track-bound vehicle.

Such a method for automatically controlling track-bound vehicles in which vehicles can be, for example, rail vehicles, track-guided vehicles with rubber tires or magnetic levitation trains, is known, for example, from the company publication "Trainguard® MT—Optimale Leistung mit dem führenden Zugbeeinflussungssystem für den Nahverkehr" (Order No.: A19100-V100-B976, Siemens AG 2014). This describes a CBTC (communication-based train control) train control system for automatic controlling track-bound vehicles in the form of underground railways or metro networks. Herein, an optimization of network capacity and network throughputs takes place in that by means of continuous, bidirectional communication between the vehicles and the track section, travel in moving spacing mode (moving block operation) is enabled. This presupposes that during operation, the track-bound vehicles report their position cyclically to a track-side device of the train control system. In case of faults, that is for example, if one of the vehicles can no longer report its position in the assured form to the track-side device, the possibility exists, for recognizing or position-determination of the track-bound vehicles, of using information of a track vacancy reporting system. However, this has the result that moving block operation is no longer possible and consequently the efficiency of the system is significantly reduced.

SUMMARY OF THE INVENTION

It is an object of the present invention to provide a method of the aforementioned type which enables efficient operation of the track-bound vehicles even in the event that one of the track-bound vehicles is faulty such that it can no longer guarantee its integrity and is consequently not in a position to report a valid and reliable position.

This object is achieved according to the invention for a method of the aforementioned type in that, in the event that one of the track-bound vehicles is faulty such that it cannot guarantee its integrity, without interrupting the travel operation of the track-bound vehicles, switching over into a fault mode takes place, wherein in the fault mode, the faulty track-bound vehicle determines a position of one of its vehicle ends and reports said position to the track-side device, together with an item of information to the effect that it cannot guarantee its integrity, and the movement authorities for the track-bound vehicles are determined by the track-side device such that in relation to the faulty track-bound vehicle, in respect of one vehicle end, the reported position is taken into account and, in respect of the other vehicle end, an item of vacancy reporting information of a track-side vacancy reporting system is taken into account.

According to the first characterizing feature, the inventive method is distinguished in that in the event that one of the track-bound vehicles is faulty such that it cannot guarantee its integrity, without interrupting the travel operation of the track-bound vehicles, switching over into a fault mode takes place. A cause for the faulty track-bound vehicle not being able to guarantee its integrity, that is, its completeness, can herein be for example, that a vehicle-side component has failed or a communication connection between the two vehicle ends of the track-bound vehicle is faulty and thus only an item of information regarding the position of one of the two vehicle ends is available. Alternatively, however, a corresponding fault can in principle also be caused thereby that the track-bound vehicle has broken apart or has lost a vehicle part, for example, in the form of one of its wagons on the track section. Herein, it should be considered that the track-bound vehicles in the context of the inventive method can consist of any desired number of powered and/or non-powered units connected and/or linked or coupled to one another firmly or loosely. The guaranteeing of the integrity of the track-bound vehicles is of great safety relevance, particularly in moving block operation, since the track-side device releases the track sections currently not occupied by the respective track-bound vehicle for other track-bound vehicles on the basis of the position reports of the track-bound vehicles.

According to the invention, the switch-over from normal operating mode into fault mode takes place without interrupting the travel operation, that is, dynamically during continuing travel operation. Preferably, this takes place without any interim automatic braking or emergency braking of the faulty track-bound vehicle or one of the other track-bound vehicles preceding or following it.

According to the second characterizing feature, in fault mode, the faulty track-bound vehicle determines a position of one of its vehicle ends and reports said position to the track-side device together with an item of information to the effect that it cannot guarantee its integrity. The inventive method is therefore characterized in that in fault mode, the faulty track-bound vehicle at least also determines the position of one of its vehicle ends and reports said position to the track-side device together with an item of information to the effect that it cannot guarantee its integrity and consequently cannot report a position relating to its other vehicle end.

According to the third characterizing feature, it is hereby advantageously enabled that the movement authorities, also often known as movement authorities (MA) for the track-bound vehicles are determined by the track-side device such that in respect of the faulty track-bound vehicle, in relation to one vehicle end, the reported position is taken into account and, in relation to the other vehicle end, an item of vacancy reporting information of a track-side vacancy reporting system is taken into account. This means that, in fault mode, the faulty track-bound vehicle is not switched out of moving block operation, that is, out of traveling at a moving spacing, into moving at a fixed spacing on the basis of vacancy reporting information of a track-side vacancy reporting system. Rather, the movement authorities for the track-bound vehicles, that is for the faulty track-bound vehicle and further track-bound vehicles the movement authorities of which are controlled by the faulty track-bound vehicle are determined by the track-side device such that in relation to the one vehicle end for which a valid safety-related position of the faulty track-bound vehicle has continued to be reported, this reported position is further used, also in fault mode. In relation only to the other vehicle end, that is, the vehicle end for which, due thereto that the faulty track-bound vehicle cannot guarantee its integrity, no position report is available, an item of vacancy reporting information of a track-side vacancy reporting system is taken into account.

The inventive method is therefore characterized in that in the event that a track-bound vehicle can no longer guarantee its integrity, switching over from normal operating mode to fault mode takes place dynamically. Thereafter, in fault mode, in relation to the two vehicle ends of the faulty track-bound vehicle, different methods are used for position determination. While the movement authorities for the track-bound vehicles are determined in relation to the one vehicle end, taking account of the available reported position, in relation to the other vehicle end, an item of vacancy reporting information of a track-side vacancy reporting system is taken into account. This has the advantage that in fault mode, a moving block operation can still largely be maintained. By this means, advantageously, the robustness and availability of the system for automatically controlling the track-bound vehicles, that is for example, the CBTC system, is ultimately improved. By this means, it is possible in particular that a faulty track-bound vehicle can complete the respective operating day before an error correction is undertaken. Furthermore, the inventive method has the advantage, in particular, that typically systems for automatically controlling track-bound vehicles, also known as a train control system, often have, as a fallback level for the event of a failure of the automatic train control system often have track-side vacancy reporting systems, for example, in the form of track vacancy reporting devices. This means that the inventive method is advantageously normally realizable without any new track-side components being necessary.

Advantageously, the inventive method can be developed such that in the event that a vehicle end which, in relation to a travel direction of the faulty track-bound vehicle, is the front vehicle end, the movement authority for the faulty track-bound vehicle is determined taking account of the reported position of the one, front vehicle end. In the event that the one vehicle end is the front vehicle end and for this therefore, a vehicle-side determined position is still available, the movement authority for the faulty track-bound vehicle can advantageously be determined taking account of the reported position of the one, front vehicle end. This means that for the faulty track-bound vehicle itself, a moving block operation is still possible. By this means, it is advantageously prevented that in respect of the faulty track-bound vehicle, on determination of its movement authority, an item of vacancy reporting information of a track-side vacancy reporting system has to be made use of. Thus at least in respect of the faulty track-bound vehicle itself, continuing trouble-free operation in the sense of travel with moving spacing is enabled, that is, a switch-over to traveling with fixed spacing on the basis of corresponding blocks of a track-side vacancy reporting system is advantageously not required.

According to a further preferred embodiment, the inventive method is configured such that in the event that a vehicle end which, in relation to a travel direction of the faulty track-bound vehicle, is the front vehicle end, the respective movement authority for at least one track-bound vehicle following the faulty track-bound vehicle at the other, rear, vehicle end is determined taking account of the vacancy reporting information of the track-side vacancy reporting system. In the event that in respect of the front vehicle end, a reported position is still available to the track-side device, a movement authority for at least one track-bound vehicle following the faulty track-bound vehicle at the other, rear, vehicle end can thus be determined taking account of the vacancy reporting information of the track-side vacancy reporting system. This means that the travel operation at least in respect of the immediately following track-bound vehicle is switched over to travel at a fixed spacing by means of corresponding blocks of the track-side vacancy reporting system.

Advantageously, the inventive method can also be configured such that in the event that the one vehicle end which, in relation to a travel direction of the faulty track-bound vehicle, is the rear vehicle end, the respective movement authority for at least one track-bound vehicle following the faulty track-bound vehicle at the one, rear, vehicle end is determined taking account of the reported position of the one, rear, vehicle end. This preferred development therefore relates to the event that the one vehicle end for which a reported position is still available is the rear vehicle end of the faulty track-bound vehicle. In this event, therefore, the possibility advantageously exists of determining the respective movement authority for at least one track-bound vehicle following the faulty track-bound vehicle at the one, rear, vehicle end, taking account of the reported position of the one, rear, vehicle end. In this situation also, therefore, the fault caused in the entire system by the faulty track-bound vehicle is advantageously minimized during the operational procedure.

In the context of the inventive method, the vacancy reporting information taken into account in respect of the other vehicle end can in principle be an item of vacancy reporting information of any desired per se known track-side vacancy reporting system.

According to another particularly preferred embodiment of the inventive method, in respect of the other vehicle end of the faulty track-bound vehicle, an item of vacancy reporting information of a track-side vacancy reporting system in the form of an axle counting system can be taken into account. This is advantageous since an axle counting system is a widely used and tested track-side vacancy reporting system.

In addition or alternatively to the aforementioned preferred development, the inventive method can advantageously also be configured such that in respect of the other vehicle end of the faulty track-bound vehicle, an item of vacancy reporting information of a track-side vacancy reporting system on the basis of track circuits is taken into account.

Track circuits also represent a well tried track-side vacancy reporting system often already present as a fallback level which can thus advantageously be used in the context of the inventive method for providing the vacancy reporting information. Even if the track-side vacancy reporting system is typically either an axle counting system or a vacancy reporting system on the basis of track circuits, it is fundamentally also conceivable that a track-side vacancy reporting system comprises both axle counting systems and track circuits. Such a combined track-side vacancy reporting system can also be used in the context of the inventive method.

The present invention further relates to a device for automatically controlling track-bound vehicles, wherein the device comprises vehicle-side devices arranged on the track-bound vehicles and a track-side device and is configured such that in a normal operating mode, the vehicle-side devices report a position of the respective track-bound vehicle to the track-side device, said track-side device determines a respective movement authority, taking account of the reported positions for the track-bound vehicles and transmits said movement authority to the vehicle-side device of the respective track-bound vehicle.

Such a device is also known from the aforementioned company publication of Siemens AG.

With regard to the device, it is an object of the present invention to provide a device of the aforementioned type which enables an efficient operation of the track-bound vehicles to be maintained even in the event that one of the track-bound vehicles is faulty such that it can no longer guarantee its integrity and is consequently not in a position to report a valid and/or reliable position.

This object is achieved according to the invention for a device of the aforementioned type in that the device is configured such that, in the event that one of the track-bound vehicles is faulty to the effect that it cannot guarantee its integrity, without interrupting the travel operation of the track-bound vehicles, said device switches over into a fault mode in which the vehicle-side device of the faulty track-bound vehicle determines a position of one of its vehicle ends and reports said position, together with an item of information to the effect that the faulty track-bound vehicle cannot guarantee its integrity, to the track-side device, and the track-side device determines the movement authorities for the track-bound vehicles such that with regard to the faulty track-bound vehicle it takes account, in respect of one vehicle end, of the reported position and, in respect of the other vehicle end, of an item of vacancy reporting information of a track-side vacancy reporting system.

The advantages of the inventive device correspond to those of the inventive method so that in this regard reference is made to the corresponding description above. The same applies with regard to the preferred developments of the inventive device mentioned below in relation to the corresponding preferred developments of the inventive method, so that in this regard also, reference is made to the corresponding description above.

Advantageously, the inventive device can be developed such that in the event that the one vehicle end which, in relation to a travel direction of the faulty track-bound vehicle is the front vehicle end, the track-side device determines the movement authority for the faulty track-bound vehicle, taking account of the reported position of the one, front vehicle end.

According to a particularly preferred development, the inventive device is configured such that in the event that the one vehicle end which, in relation to a travel direction of the faulty track-bound vehicle, is the front vehicle end, the track-side device determines the respective movement authority for at least one track-bound vehicle following the faulty track-bound vehicle at the other, rear, vehicle end, taking account of the vacancy reporting information of the track-side vacancy reporting system.

Preferably, the inventive device can also be configured such that in the event that the one vehicle end which, in relation to a travel direction of the faulty track-bound vehicle, is the rear vehicle end, the track-side device determines the respective movement authority for at least one track-bound vehicle following the faulty track-bound vehicle at the one, rear, vehicle end, taking account of the reported position of the one, rear, vehicle end.

According to another particularly preferred embodiment of the inventive device, in respect of the other vehicle end of the faulty track-bound vehicle, the track-side device takes account of an item of vacancy reporting information of a track-side vacancy reporting system in the form of an axle counting system.

Advantageously, the inventive device can also be configured such that, in respect of the other vehicle end of the faulty track-bound vehicle, the track-side device takes account of an item of vacancy reporting information of a track-side vacancy reporting system on the basis of track circuits.

BRIEF DESCRIPTION OF THE SEVERAL VIEWS OF THE DRAWING

The invention will now be described in greater detail making reference to exemplary embodiments. In the drawings.

In the figures, identical reference signs are used for the same components in each case.

DESCRIPTION OF THE INVENTION

Figure 1:
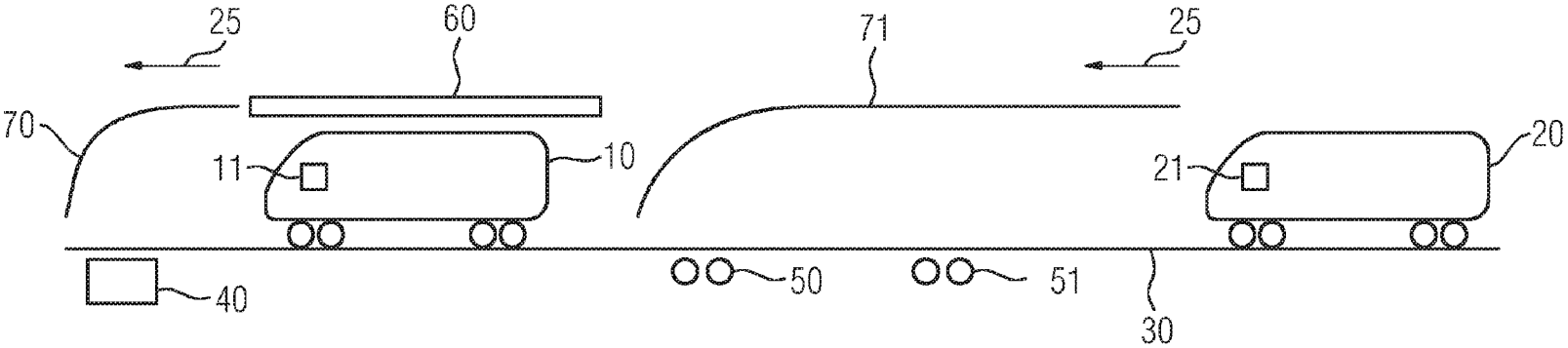
FIG. 1 is a schematic sketch of a device for automatically controlling track-bound vehicles in a situation in which the track-bound vehicles are operated in a normal operating mode.

FIG. 1 shows, in a schematic sketch, a device for automatically controlling track-bound vehicles in a situation in which the track-bound vehicles are operated in a normal operating mode. In concrete terms, it is assumed that the track-bound vehicles 10, 20 are rail vehicles which each have a vehicle-side device 11 or 21. The vehicle-side devices 11, 21 can be, for example, vehicle units of an automatic train control system.

According to the representation in FIG. 1, the track-bound vehicles 10, 20 move in a travel direction 25, that is, from right to left. Herein, indicated at the guideway 30 in the form of a track is a track-side device 40 which can comprise, for example, at least one track unit of the automatic train control system. In addition, the track-side device 40 can also comprise at least one central track-side control device which is connected by communication means to the at least one track unit. Since relevant track-side components of automatic train control systems are per se sufficiently well known, for the sake of clarity, they are shown in FIG. 1 exclusively in the form of the track-side device 40.

Apart from the track-side device 40, also indicated on the track-side are axle counters 50 and 51. Herein, the axle counters 50, 51 are a component of a track-side vacancy reporting system in the form of an axle counting system which is provided for the event that an automatic train control operation in moving block operation is not possible due to a fault. This means that the axle counters 50, 51 or a corresponding item of vacancy reporting information provided thereby are not used in the normal operating mode of the automatic train control system. Rather, in the normal operating mode, the respective position of the track-bound vehicles 10, 20 is reported by them to the track-side device 40. Herein, in FIG. 1, by way of example, the position reported by the track-bound vehicle 10 is indicated in the form of a "position band" or "position range" 60. This position band covers the region between the two vehicle ends of the track-bound vehicle 10 and preferably also takes account of additional aspects such as, for example, buffer overhangs or safety margins due to the accuracy of the positional resolution. In a corresponding manner, the track-bound vehicle 20 also reports its position cyclically to the track-side device 40.

On the side of the track-bound vehicle 10, the train position indicated by the position range 60 can be determined, for example, in known manner by means of a vehicle-side odometry system, for example, using a wheel impulse generator in combination with track-side balises. Alternatively, it is herein also conceivable, for example, that the positions of the vehicle ends of the track-bound vehicle 10 are determined with satellite support, that is, by means of a GNSS (global navigation satellite system) receiver. Furthermore, a determination of the position of the vehicle ends of the track-bound vehicle 10 can also take place, for example, through the location of a vehicle-side receiver in a radio network. This can take place, for example, in that on the vehicle side, the reports received from track-side access points of the radio network are evaluated and the position of the track-bound vehicle relative to the access points is determined. Herein as the radio network, for example, a WLAN (wireless local area network), for example according to the standard IEEE 802.11, or a mobile radio network, for example according to one of the standards GSM (global system for mobile communications), GPRS (general packed radio service), UMTS (universal mobile telecommunications system) or LTE (long term evolution) can be used.

In the context of the exemplary embodiment described, it is to be assumed that the vehicle-side devices 11, 21 of the track-bound vehicles 10, 20 comprise suitable means for determining the position of the respective track-bound vehicle 10, 20. Depending upon the respective embodiment, it is herein possible that at the respective other vehicle end, a suitable vehicle-side device or at least means for determining the position of the relevant vehicle end are provided. Alternatively thereto, it can also suffice that on the part of the respective vehicle-side device 11, 21, the position of the one, in the present case, front vehicle end is determined and the integrity of the track-bound vehicles 10 or 20 is guaranteed by a corresponding vehicle-side monitoring. This can take place, for example, by means of a corresponding communication connection between the vehicle ends of the track-bound vehicles 10, 20.

At this point, it should be noted that, as distinct from the simplified schematic representation of FIG. 1, the track-bound vehicles 10, 20 typically each consist of a plurality of mutually joined, or linked or coupled units. Thus a monitoring of the integrity of the track-bound vehicles 10, 20 is usually significant particularly in such cases in which they consist of a plurality of units, for example, in the form of railcars.

In normal operating mode, a respective movement authority 70, 71 is determined by the track-side device 40, taking account of the positions for the track-bound vehicles 10, 20 reported by the vehicle-side devices 11, 21 of the track-bound vehicles 10, 20 and said movement authority is transmitted to the respective track-bound vehicle 10, 20. Herein, the respective movement authorities 70, 71 in FIG. 1 are indicated by curves which indicate in particular the point to which the respective movement authority 70, 71 of the respective track-bound vehicle 10, 20 extends. It is herein apparent with respect of the track-bound vehicle 20 following the track-bound vehicle 10, that the movement authority 71 is delimited by the position indicated by means of the region 60 of the vehicle end of the track-bound vehicle 10 that is rearward in the travel direction 25. This means that travel in moving spacing, that is, a moving block operation takes place, advantageously permitting a best possible utilization with regard to network capacity and network throughput. In a similar manner, the movement authority 70 of the track-bound vehicle 10 extends as far as a point which is delimited by the position of a track-bound vehicle (not shown in FIG. 1) traveling ahead of the track-bound vehicle 10 at a smaller spacing.

The scenario shown in FIG. 1, therefore, is the normal operating mode of a CBTC train control system. For the corresponding operating mode, it is an essential precondition that the track-bound vehicles 10, 20 report to the track-side device 40 the positions of their vehicle ends or a position indication in conjunction with an explicit or implicit item of information to the effect that the respective track-bound vehicle 10, 20 can guarantee its integrity. Should this no longer be possible, for example, for the track-bound vehicle 10, then this would normally lead thereto that in relation to both the track-bound vehicles 10 and 20, an automatic braking is initiated and in a fallback mode, switching over takes place to complete use of the axle counting system with the axle counters 50, 51 for the purpose of controlling and safeguarding the rail-bound vehicles 10 and 20.

Figure 2:
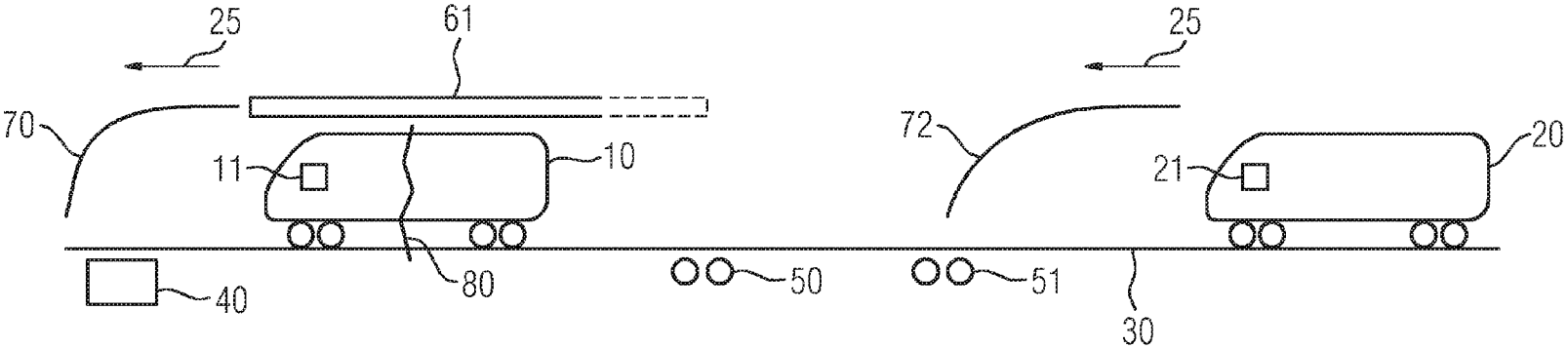
FIG. 2 is a further schematic sketch of a device for automatically controlling track-bound vehicles in a situation in which due thereto that one of the track-bound vehicles can no longer guarantee its integrity, switching over has taken place from the normal operating mode into a fault mode.

FIG. 2 shows a further schematic sketch of a device for automatically controlling track-bound vehicles in a situation in which due thereto that one of the track-bound vehicles can no longer guarantee its integrity, switching over has taken place from the normal operating mode into a fault mode.

In the situation shown in FIG. 2, the track-bound vehicle 10 is faulty to the effect that it cannot or can no longer guarantee its integrity. This is indicated by an "interruption symbol" 80 which can represent either an actual physical separation of the track-bound vehicle 10 or of units thereof, as well as for a component failure or a communication fault which lead thereto that although the track-bound vehicle 10 is still intact, it can no longer make a reliable or valid statement regarding its integrity. Thus, in addition to the vehicle-side device 11 arranged at the front vehicle end, the track-bound vehicle 10 can have a further corresponding vehicle-side device arranged at the rear vehicle end, which can serve, inter alia, for determining the position of the relevant vehicle end and/or for communication with the vehicle-side device 11 for the purpose of confirming the integrity of the track-bound vehicle 10. In the event of a failure of the further vehicle-side device or in the event of a fault in the communication between the vehicle-side device 11 and the further vehicle-side device, the situation arises that it is not possible for the track-bound vehicle 10 to effect, in relation to both its vehicle ends, a reliable, safety-relevant statement with regard to its position.

In the context of the exemplary embodiment described, it is herein assumed that due to the respective fault of the track-bound vehicle 10 without interrupting travel operation of the track-bound vehicles 10 and 20, switching over takes place from the normal operating mode of the train control system into a fault mode. This means that the switch-over from the normal operating mode into the fault mode takes place dynamically wherein in this relation, preferably no automatic braking of the track-bound vehicles 10, 20 is required.

In the fault mode, the faulty track-bound vehicle 10 further determines a position of one of its vehicle ends, that is in this case, the front vehicle end at which the vehicle-side device 11 is arranged. The determined position of the one vehicle end is reported to the track-side device 40 by the track-bound vehicle 10 or its vehicle-side device 11 together with an item of information to the effect that it cannot guarantee its integrity.

The movement authorities 61 and 72 for the track-bound vehicles 10, 20 are now determined by the track-side device 40 such that in respect of the faulty track-bound vehicle 10, in relation to the one front vehicle end, the reported position is taken into account and, in relation to the other, rear, vehicle end, an item of vacancy reporting information of the track-side vacancy reporting system is taken into account. This is indicated in FIG. 2 by a position band 61 which indicates the position of the track-bound vehicle 10 reported during fault mode or used by the track-side device 40. It is herein apparent that no change takes place in relation to the one, front, vehicle end of the track-bound vehicle 10 as compared with FIG. 1. This means that the faulty track-bound vehicle 10 can continue to travel in moving block operation.

In respect of the other, that is rear, vehicle end, for the control of the track-bound vehicles 10, 20, however, an item of vacancy reporting information from a track-side vacancy reporting system in the form of the axle counting system with the axle counters 50 and 51 is taken into account. On the basis of the available vacancy reporting information, it is herein possible for the track-side device 40 to delimit the rear vehicle end of the track-bound vehicle 10 by means of the position of the axle counter 50. The additional position range which the track-bound vehicle 10 or parts thereof can therefore occupy is indicated in FIG. 2 by a dashed part of the position band 61.

Since when traveling with a fixed spacing, typically at least one free block is required between the track-bound vehicles 10 and 20, this leads in the situation shown in FIG. 2 thereto that the movement authority 71 granted in normal operating mode to the track-bound vehicle 20 which follows the faulty track-bound vehicle 10 is revoked and is replaced with a new movement authority 72. Herein, this new movement authority 72 is delimited by the position of the axle counter 51.

It should be noted that, as distinct from the representation of FIGS. 1 and 2, it is also possible that the one vehicle end is the rear vehicle end in relation to the travel direction 25 of the faulty track-bound vehicle 10. In this case, advantageously, the respective movement authority for at least one track-bound vehicle 20 following the faulty track-bound vehicle 10 at the one, rear, vehicle end, can be determined taking account of the reported position of the one, rear, vehicle end. This means that in this case in respect of the following track-bound vehicle 20, a moving block operation can be maintained.

The method described above and the associated device are characterized in particular in that through the skillful combination of the available information, the efficiency of the system for automatically controlling the track-bound vehicles 10, 20 in the form of the respective train control system is improved in the event of train integrity faults. This applies particularly in relation to the robustness and availability of CBTC systems since a moving block operation is maintained whenever possible and switching over only takes place in the absolutely necessary extent of a use of the vacancy reporting information of the track-side vacancy reporting system. As a result, this therefore leads thereto that, in the event that one of the track-bound vehicles 10, 20 can no longer guarantee its integrity and therefore switching over to a fault mode takes place, the travel operation can be largely maintained. This has the result that even a faulty track-bound vehicle can advantageously firstly still complete the operating day before correction of the fault takes place. By this means, therefore operating disruptions due to train integrity faults can be minimized and in the event of their occurrence, resolved as rapidly as possible. Advantageously, herein in the respective system, components and mechanisms that are often already present can be dynamically combined such that an increase in the robustness and thus of the efficiency of the overall system results.

The invention claimed is:

1. A method of automatically controlling track-bound vehicles, wherein, in a normal operating mode:

the track-bound vehicles report their respective positions to a track-side device; and the trackside device determines a respective movement authority for the track-bound vehicles, taking into account the positions reported by the track-bound vehicles, and the movement authority is transmitted to the respective track-bound vehicle;

the method comprising:

in the event that one of the track-bound vehicles is a faulty track-bound vehicle whose integrity cannot be guaranteed, switching over to a fault mode without interrupting a travel operation of the track-bound vehicles; and in the fault mode:

causing the faulty track-bound vehicle to determine a position of one vehicle end thereof and to report the position of the one vehicle end to the track-side device together with an item of information indicating that an integrity of the position of the one vehicle end cannot be guaranteed; and determining the movement authorities for the track-bound vehicles with the track-side device and, with respect to the faulty track-bound vehicle, taking into account the reported position of the one vehicle end and, in respect of the other vehicle end, an item of vacancy reporting information of a track-side vacancy reporting system.

2. The method according to claim 1, wherein, in relation to a travel direction of the faulty track-bound vehicle, the one vehicle end whose position has been reported is a forward vehicle end, the movement authority for the faulty track-bound vehicle is determined taking account of the reported position of the forward vehicle end.

3. The method according to claim 1, wherein, in relation to a travel direction of the faulty track-bound vehicle, the one vehicle end whose position has been reported is a forward vehicle end, the respective movement authority for at least one track-bound vehicle following the faulty track-bound vehicle at a rearward vehicle end is determined taking account of the vacancy reporting information of the track-side vacancy reporting system.

4. The method according to claim 1, wherein, in relation to a travel direction of the faulty track-bound vehicle, the one vehicle end whose position has been reported is a rearward vehicle end, the respective movement authority for at least one track-bound vehicle following the faulty track-bound vehicle at the rearward vehicle end is determined taking account of the reported position of the rearward vehicle end.

5. The method according to claim 1, which comprises, in respect of the other vehicle end of the faulty track-bound vehicle, taking into account an item of vacancy reporting information of a track-side vacancy reporting system in the form of an axle counting system.

6. The method according to claim 1, which comprises, in respect of the other vehicle end of the faulty track-bound vehicle, taking into account an item of vacancy reporting information of a track-side vacancy reporting system based on track circuits.

7. A device for automatically controlling track-bound vehicles, the device comprising:

vehicle-side devices disposed on the track-bound vehicles and a track-side device configured to operate in a normal operating mode and in a fault mode;

in the normal operating mode:

said vehicle-side devices report a position of the respective track-bound vehicle to said track-side device;

said track-side device determines a respective movement authority, taking account of the reported positions of the track-bound vehicles and transmits the movement authority to said vehicle-side device of the respective track-bound vehicle;

said track-side device being configured, in the event that one of the track-bound vehicles is a faulty track-bound vehicle to the effect that the track-bound vehicle cannot guarantee an integrity thereof, without interrupting a travel operation of the track-bound vehicles, said track-side device switches over into the fault mode; and in the fault mode:

said vehicle-side device of the faulty track-bound vehicle being configured to determine a position of one vehicle end thereof and to report the position to said track-side device together with an item of information indicating that the faulty track-bound vehicle cannot guarantee an integrity of the position of the one vehicle end; and said track-side device being configured to determine the movement authorities for the track-bound vehicles and, with regard to the faulty track-bound vehicle, to take into account, in respect of the one vehicle end, the reported position and, in respect of the other vehicle end, an item of vacancy reporting information of a track-side vacancy reporting system.

8. The device according to claim 7, wherein, in the event that the one vehicle end which, in relation to a travel direction of the faulty track-bound vehicle, is a forward vehicle end, said track-side device determines the movement authority for the faulty track-bound vehicle, taking into account the reported position of the forward vehicle end.

9. The device according to claim 7, wherein, in the event that the one vehicle end which, in relation to a travel direction of the faulty track-bound vehicle, is a forward vehicle end, said track-side device determines the respective movement authority for at least one track-bound vehicle following the faulty track-bound vehicle at a rearward vehicle end, taking into account the vacancy reporting information of the track-side vacancy reporting system.

10. The device according to claim 7, wherein, in the event that the one vehicle end which, in relation to a travel direction of the faulty track-bound vehicle, is a rearward vehicle end, said track-side device determines the respective movement authority for at least one track-bound vehicle following the faulty track-bound vehicle at the rearward vehicle end, taking into account the reported position of the rearward vehicle end.

11. The device according to claim 7, wherein in respect of the other vehicle end of the faulty track-bound vehicle, said track-side device is configured to take into account an item of vacancy reporting information of a track-side vacancy reporting system comprising an axle counting system.

12. The device according to claim 7, wherein in respect of the other vehicle end of the faulty track-bound vehicle, said track-side device is configured to take into account an item of vacancy reporting information of a track-side vacancy reporting system based on track circuits.

* * * * *